US008109249B2

(12) United States Patent
König

(10) Patent No.: US 8,109,249 B2
(45) Date of Patent: Feb. 7, 2012

(54) VALVE CONTROL FOR A GAS EXCHANGE VALVE IN AN INTERNAL COMBUSTION ENGINE

(75) Inventor: Nikolaus König, Althegnenberg (DE)

(73) Assignee: MAN Diesel SE, Augsburg (DE)

( * ) Notice: Subject to any disclaimer, the term of this patent is extended or adjusted under 35 U.S.C. 154(b) by 319 days.

(21) Appl. No.: 12/479,989

(22) Filed: Jun. 8, 2009

(65) Prior Publication Data

US 2009/0301417 A1 Dec. 10, 2009

(30) Foreign Application Priority Data

Jun. 10, 2008 (DE) ..... 10 2008 027 650

(51) Int. Cl.
*F01L 3/10* (2006.01)

(52) U.S. Cl. ..... 123/90.65; 123/90.12; 123/90.66

(58) Field of Classification Search ..... 123/90.12, 123/90.13, 90.65, 90.66, 90.67
See application file for complete search history.

(56) References Cited

U.S. PATENT DOCUMENTS 4,930,464 A 6/1990 Letsche
5,673,658 A 10/1997 Allmendinger
7,156,058 B1 * 1/2007 Lou ..... 123/90.12

* cited by examiner

*Primary Examiner* — Ching Chang
(74) *Attorney, Agent, or Firm* — Cozen O'Connor

(57) ABSTRACT

A valve control for a gas exchange valve of an internal combustion engine includes at least one spring element for preloading the valve in an end position and a fixing device for the releasable fixing of the valve. The spring element in a moveable insert, which by means of an actuation device is adjustable in actuation direction of the valve between an end position close to the valve disc and an end position far from the valve disc for adjusting a preload applied on the valve by the spring element.

12 Claims, 6 Drawing Sheets

VALVE CONTROL FOR A GAS EXCHANGE VALVE IN AN INTERNAL COMBUSTION ENGINE

BACKGROUND OF THE INVENTION

1. Field of the Invention

The invention relates to a valve control for a gas exchange valve in an internal combustion engine, with at least one spring element preloading the valve in at least one end position, and a fixing device for the releasable fixing of the valve.

2. Description of the Related Art

A multiplicity of valve controls for gas exchange valves in internal combustion engines are known from the prior art. Generally, mechanical, hydraulic or electrical valve controls can be distinguished.

With purely mechanical valve controls the actuation of the gas exchange valve is controlled through a cam whose actuation is transmitted through suitable mechanical transmission elements such as pushrods, rocker arms and similar. The disadvantage of these purely mechanical valve controls is that the actuation of the gas exchange valve is directly coupled to the operation of the engine and adjusting of the opening time or even the actuation travel of the gas exchange valve is at best possible with major technical expenditure.

In the case of purely hydraulic and electrical valve controls the actuation of the gas exchange valve is performed with the help of hydraulic or electrical actuation devices which directly or indirectly act on the gas exchange valve. In the process, opening times, opening speeds and actuation travels of the gas exchange valve can be specifically set by corresponding activation of the actuation devices and, as a function of the operating parameters of the internal combustion engine such as the rotational speed, the rotational moment, the emission values or the operating temperature of the internal combustion engine can be modified.

An example for a hydraulic valve control is shown by U.S. Pat. No. 4,930,464, wherein the gas exchange valve is guided in an hydraulic actuation chamber with the help of a piston section and mechanically clamped through two compression springs opposing each other. The piston section subdivides the actuation chamber into two chamber sections which are in connection with a hydraulic supply so that the piston section is hydraulically clamped in. For adjusting the gas exchange valve the two chamber sections are each specifically filled with a hydraulic fluid or said fluid drained from one or the two chamber sections, wherein the actuation movement is supported by the two compression springs.

U.S. Pat. No. 5,673,658 shows a hydraulic valve control wherein the stem of the gas exchange valve is mechanically clamped in through two compression springs opposing each other, wherein in the rest position the compression spring near the valve disc preloads the gas exchange valve in its closed end position. For adjusting the gas exchange valve a hydraulic actuation device is provided at its end facing away from the valve disc with which, through support of the other compression spring far from the valve disc the gas exchange valve can be opened against the force of the compression spring close to the valve disc. In addition, a fixing device likewise to be actuated hydraulically is provided with which the gas exchange valve can be releasably fixed or secured in its closed end position, an intermediate position and a completely open position.

The disadvantage of this hydraulic valve control known from U.S. Pat. No. 5,673,658 is that although the valve control has improved adjustability and variability of the opening times, the opening durations and the actuation travels of the gas exchange valves compared with purely mechanical valve controls, comparatively high hydraulic forces have to be generated because of the spring arrangements in order to actuate the gas exchange valve.

SUMMARY OF THE INVENTION

According to the invention, at least one spring element for preloading the valve is supported in a moveable insert, wherein this moveable insert is to be actuated with the help of an actuation device in actuation direction of the valve between an end position close to the valve disc and an end position far from the valve disc for adjusting the preload acting on the valve through the spring element or spring elements and preferably secure it in the adjusted position.

Contrary to the procedure usual with hydraulic valve controls, with the valve control according to the invention it is not the valve itself but the insert serving as support bearing for the spring elements in which the gas exchange valve is suspended that is moved with the help of the actuation device.

By adjusting the insert, the preload with which the spring element preloads the gas exchange valve in at least one of its end positions can be adjusted. In the process, the gas exchange valve can be held in its preloaded position with the help of the fixing device, which releasably fixes or secures the gas exchange valve. As soon as the fixing device releases the gas exchange valve, the gas exchange valve (because of the previously adjusted preloading force) moves the spring elements in the direction of its respective opposite end position, where it can be fixed again in its opened or closed position. In the process, through the movement of the gas exchange valve, energy introduced into the spring element is advantageously stored as soon as the fixing device fixes the gas exchange valve, for example in the dead center position of the reversal movement of the gas exchange valve. When the fixing device again releases the gas exchange valve, this stored energy is freed again. Here, too, the preload force of the spring element can be modified and adjusted by adjusting the insert. In this manner the necessary energy for the valve control can be reduced.

Through the valve control according to the invention, the gas exchange valve of the internal combustion engine can be very quickly actuated independent of other gas exchange valves. A substantial advantage is that a major part of the kinetic energy liberated during the actuation of the gas exchange valve is again stored or reclaimed by the spring element, whereby the energy to be introduced into the actuation device merely corresponds to the energy lost through friction in the total system.

A further advantage of the adjustability of the insert is that the required lift movement of the spring element itself can be less than the valve stroke through which particularly rapid opening of the gas exchange valve is possible. Here, the time between the actual actuation movements of the gas exchange valve can also be utilized to specifically preload the spring element with the help of the insert so that for preloading the spring element the short valve lifting time known with valve controls otherwise known is not significant. The actuation movement of the gas exchange valve is ultimately triggered by the fixing device, which fixes and secures the gas exchange valve in its preloaded position until the valve stroke is triggered. The actual movement of the gas exchange valve, other than with purely hydraulic valve controls, is not effected through the actuation device itself but through the preloaded spring element or spring elements.

By suitable adjusting of the insert, different preloads of the system in the direction of the lifting movements can be preset so that the maximum opening stroke of the gas exchange valve can then be steplessly varied. In addition to this, the fixing device makes it possible to fix the gas exchange valve also in half or partly opened positions. Furthermore an overlapping movement of the insert and the gas exchange valve can be made possible for time-critical movements. If a plurality of gas exchange valves of a cylinder is equipped with the valve control according to the invention, individual activation of the gas exchange valves is possible. A variation of the load layering is therefore possible by staggering movement of the gas exchange valves in time.

In a particularly preferred embodiment of the valve control according to the invention, the valve is preloaded in the respective end positions through at least two compression springs acting against each other, wherein both springs are supported in the insert. By using two or more compression springs, one compression spring can be elastically preloaded through compression when the other compression spring relaxes upon triggering of the valve stroke. On swinging through the equilibrium position, the kinetic energy of the valve, through the free suspension of the valve between the two compression springs, preloads the compression spring opposing the movement and thus the previously liberated energy is stored again.

The compression springs in this case can be designed identically. It is however also conceivable that the compression springs have different spring constants and/or actuation travels.

As actuation device for the insert, a hydraulic actuation device is preferable since this makes possible precise adjustment of the insert with relatively little use of energy. High speed and the hydraulic fluid simultaneously also reduces developing vibrations in the valve control because of its damping characteristics.

When used, the hydraulic actuation device is preferably equipped with an adjusting chamber in which the insert is guided and hydraulically clamped in. Through the hydraulic clamping-in of the insert, the insert can be positioned very accurately, while undesirable relocation of the insert is simultaneously prevented.

Alternatively, it is possible to use an electrical actuation device, for example an actuation motor coupled with the insert via suitable mechanical couplings, for example a rack-pinion arrangement. Electromagnetic, pneumatic or other actuation devices are also possible.

The fixing device can also be activated hydraulically, pneumatically and/or electrically. The fixing device to this end is for example equipped with a hydraulic or electrical actuator which engages with an arresting mechanism with the gas exchange valve, preferably its valve stem, securing the stem in the respective desired position. The arresting mechanism for this purpose can be embodied as clamping mechanism which through suitable clamping of the valve stem fixes or secures the gas exchange valve in the respective desired position. Furthermore it is possible on the gas exchange valve, preferentially on the valve stem, to provide depressions, for example circumferential grooves which engage with a shaped element of the arresting mechanism, for example an elastically preloaded ball, for fixing or securing the gas exchange valve in order to predetermine the holding position in a defined manner or prevent relocation of the gas exchange valve in the held state.

It is of particular advantage if the position of the insert along its actuation travel is sensed with the help of a travel sensor designed for this purpose, for example an inductive sensor, through which very exact positioning of the insert during the operation of the valve control becomes possible. The travel sensor to this end is preferably coupled with a management system or an engine control of the internal combustion engine in which, based on the current engine parameters, the preload of the spring element can be newly adjusted.

Furthermore it is an advantage if the position of the valve, preferentially the valve stem, is captured along its actuation travels in order to ensure accurate positioning, more preferably opening and closing of the gas exchange valve. To this end, a travel sensor which is coupled with the management system of the internal combustion engine is preferably provided in the valve control at the same time. Furthermore it can be monitored if the gas exchange valve is jammed.

Through the combined use of such travel sensors for the insert and the valve, opening position and actuation speed during the actuation movement of the gas exchange valve can be advantageously captured. This allows controlled and if applicable regulated opening and closing of the gas exchange valve in a simple manner.

In order to achieve optimum adjustment of the gas exchange in the internal combustion engine, both the fixing device as well as the actuation device can be coupled with the engine regulation or control (engine management). The engine control then actuates the fixing device and the actuation device according to predetermined rules utilizing measured engine parameters such as rotational speed, torque, engine temperature, emission values and such so that predetermined optimum operating parameters are maintained.

Furthermore, with a particularly preferred embodiment of the valve control, the stem of the valve is in two parts, wherein a first stem section is accommodated and guided in the insert while a second stem section is guided in a valve guide immediately adjacent to the valve seat and is releasably connected with the first stem section through a coupling. The actual valve control thereby forms an independent constructional unit which can be easily and quickly assembled or in the event of maintenance, disassembled.

Only through the controlled fixing of the valve in the end position no reliable preload of the valve seat in the closed position is achieved. The closing force is preferably achieved by axially moving the entire clamping mechanism through a hydraulic cylinder. After the closing position has been very precisely reached through the electronic travel control and/or mechanical positioning systems, the mechanical stroke of the preloading cylinder is negligibly small (very low energy requirement). Nevertheless, a small movement in the direction of the closing position of the valve takes place with every closing operation. The preloading cylinder must therefore be hydraulically unloaded from the closed position with every opening of the clamping mechanism and in the process moved back again in a defined starting position through a spring.

The rotation-symmetrical insert can be designed using hydraulic or mechanical measures so that with every lifting movement a minimal rotation takes places so that the valve seat is not subject to one-sided wearing.

In the following the invention is explained in more detail by means of an exemplary embodiment making reference to the drawing.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
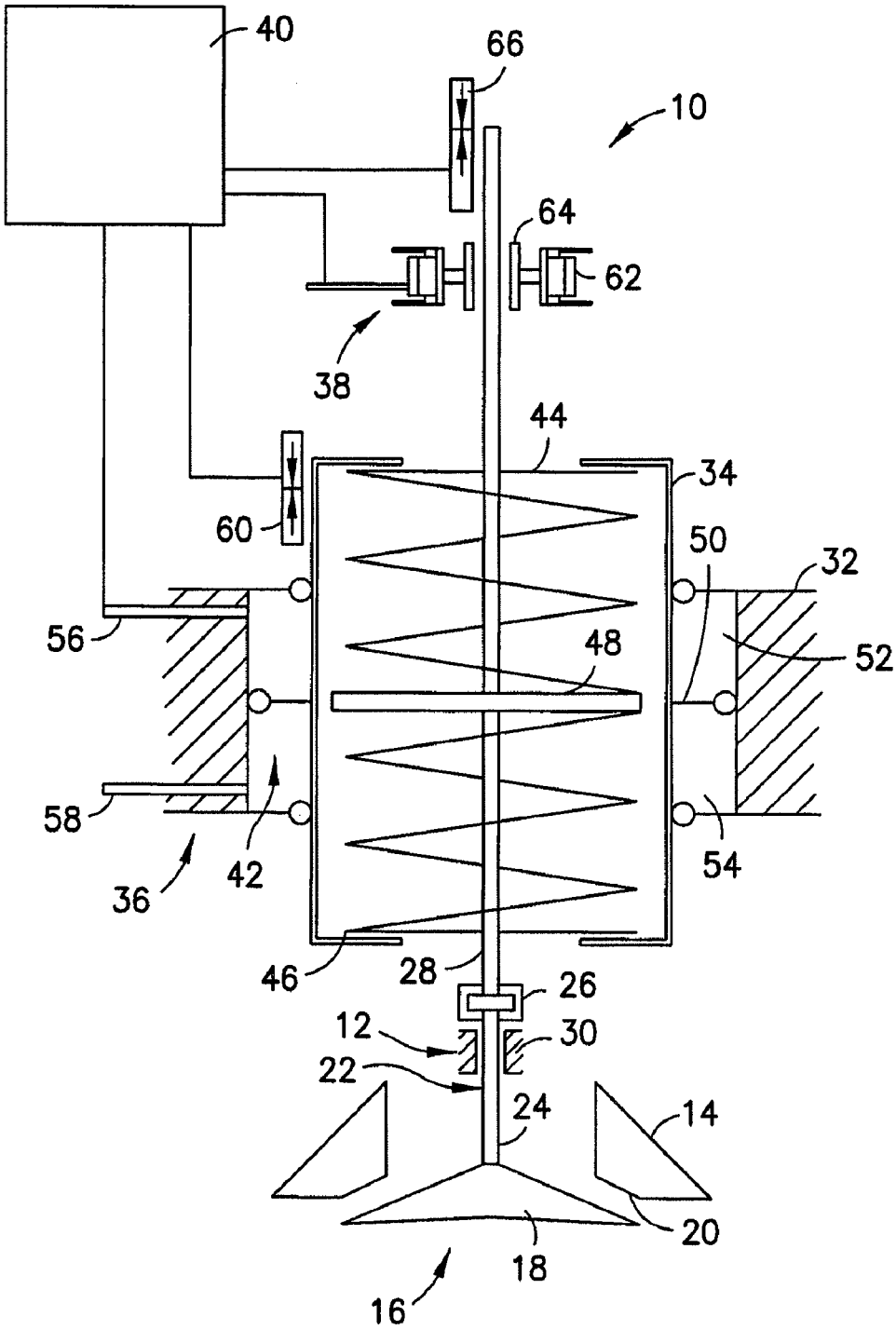
FIG. 1 is a schematic side view of a valve control of a gas exchange valve according to an embodiment of the present invention.

FIG. 1 shows a valve control 10 for a gas exchange valve 12 in an internal combustion engine according to an embodiment of the present invention. For the sake of clarity, only a small section of the cylinder head 14 and the cylinder 16 of the internal combustion engine is indicated.

The valve 12 includes a valve disc 18 extending into the cylinder 16 by way of an inlet or exhaust opening of the cylinder 16 in known manner. The valve disc 18 is moveable between a first end position, in which the valve disc 18 bears against a valve seat 20 (refer FIG. 3*a*), and an opened second end position (refer FIG. 4*a*) in which the inlet or exhaust opening is opened.

The stem 22 of the valve 12 includes a first stem section 24 embodied in one piece with the valve disc 18 and a second stem section 28 releasably connected with the former via a coupling 26. The coupling 26 is designed so that the valve control 10 can be released from the first stem section 24 for example for maintenance purposes.

The second stem section 28 protrudes through an insert 34 of an actuation device 36 accommodated in a housing 32 of the valve control 10 and through a fixing device 38 arranged close to its end far from the valve disc. As will be explained in detail later on, the two devices 36 and 38 are connected with a regulation device 40 of the engine management of the internal combustion engine and are actuated by the regulation device, The insert 34 is guided in an actuation chamber 42 of the actuation device 36 in actuation direction of the valve 12 in a longitudinally displaceable and sealing manner. In the interior of the insert 34 a first compression spring 44 far from the valve disc and a second compression spring 46 close to the valve disc are accommodated. The compression springs 44 and 46 act opposite to each other and are supported on a collar 48 of the valve 12, which protrudes radially from the second stem section 28.

On its outer circumference, the insert 34 is provided with a circumferential sealing collar 50 which is in sealing contact with the inner wall of the actuation chamber 42 and subdivides the actuation chamber 40 into a first chamber section 52 far from the valve disc and a second chamber section 54 close to the valve disc. Each chamber section 52 and 54 is in connection with a hydraulic supply of the actuation device 36 (not shown) via a respective channel 56 and 58 so that the insert 34 is clamped between the two chamber sections 52 and 54 filled with hydraulic fluid. By modifying the volumes, the position of insert 34 can be adjusted in a defined manner away from the valve seat 20 (upwards in FIG. 1) or towards the valve seat 20 (downwards in FIG. 1) and secured in the respective set position. The position of insert 34 in the process is sensed by a travel sensor 60 arranged laterally of the insert 34, which, like the hydraulic supply of the actuation device 36, is connected with the regulation device 40 of the engine management.

The fixing device 38 includes a likewise hydraulically actuated actuator 62 which is coupled with a clamping mechanism 64 for the second stem section 28. The fixing device 38 is likewise connected with the regulation device 40 and with its clamping mechanism 64 generates such high clamping forces that the valve 12 is fixed or secured in the respective set position against the forces caused by the two compression springs 44 and 46. In the process, the position of the valve 12 is sensed by a second travel sensor 66 which is arranged adjacent to the fixing device 38 and is likewise in connection with the regulation device 40.

In the following, the operation of the valve control 10 according to the invention is explained in more detail by means of FIGS. 2*a* to 2*c*, 3*a* to 3*d* and 4*a* to 4*d*.

Figure 2C:
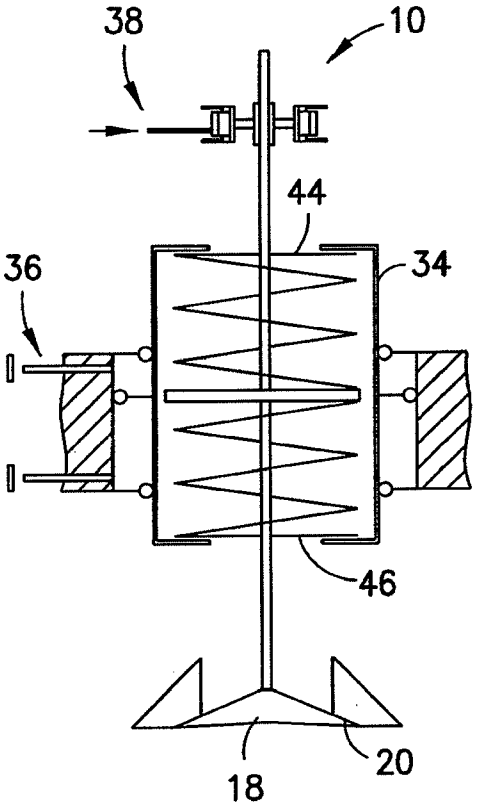
FIGS. 2*a-c* show the valve control from FIG. 1 in a starting position, for example immediately after the assembly.
Figure 2B:
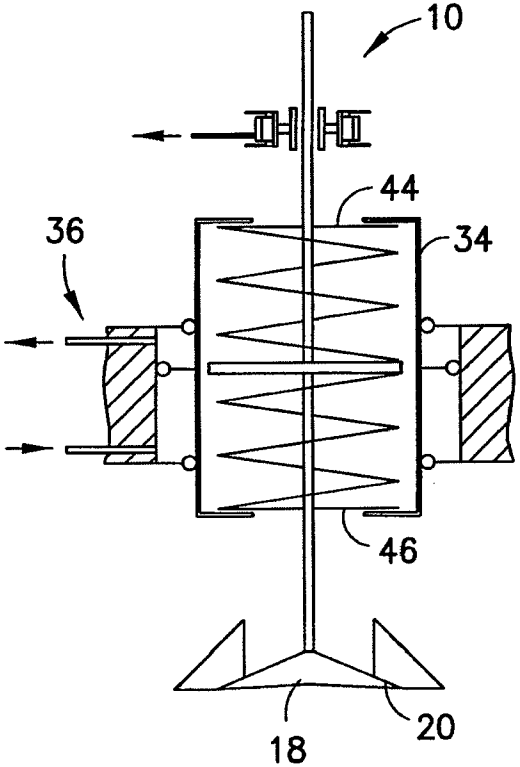
Figure 2A:
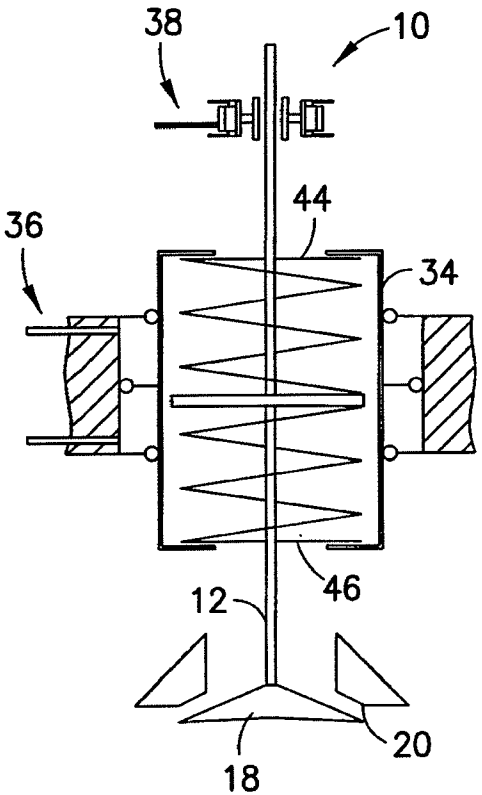

FIG. 2*a* shows the valve control 10 in a position of rest as for example occurs immediately following the installation. The two compression springs 44 and 46 are in force equilibrium, so that the collar 48 is positioned centrally in the insert 34. The two chamber sections 52 and 54 are evenly filled with hydraulic fluid so that the sealing collar 50 of the insert 34 is positioned centrally in the actuation chamber 42. The fixing device 38 is opened so that the valve 12 is held exclusively through the compression springs 44 and 46 and in this position of rest finds itself in a slightly opened position.

In FIG. 2*b* the second chamber section 54 close to the valve disc is filled with hydraulic fluid while hydraulic fluid is expelled from the second chamber section 56. Because of this, the entire insert 34 with the valve 12 suspended therein is moved away from the valve seat 20 so that the valve disc 18 comes to bear against the valve seat 20. As soon as the inlet or exhaust opening is closed by the valve disc 18, the actuation device 36 is deactivated and the fixing device 38 activated, which then fixes or secures the valve 12 in the newly set position as shown in FIG. 2*c*.

The process for opening the valve 12 is explained in more detail by means of FIG. 3*a* to 3*d*. As soon as the regulation device 40 in response to current operating parameters of the internal combustion chamber wants to open the valve 12, it activates the actuation device 36 so that the insert 34 is moved from the position shown in FIG. 2*c* towards the valve seat 20, i.e. is lowered in FIG. 2*c*. Since the valve 12 is secured in its position by the fixing device 38, the lowering of the insert 34 brings about a compression of the first compression spring 44 and simultaneously elongation of the second compression spring 46, as a result of which a predeterminable preload produced through the compression springs 44 and 46 is set, which preloads the valve secured in the fixing device 38 away from the valve seat 20 (downwards in FIG. 3*a*). As soon as the first travel sensor 60 senses that the insert 34 is located in a position predetermined by the regulating device 40, the hydraulic supply of the actuation device 36 is deactivated and the supply through the channels 56 and 58 interrupted so that the insert 34 remains hydraulically clamped in its new position.

Figure 3A:
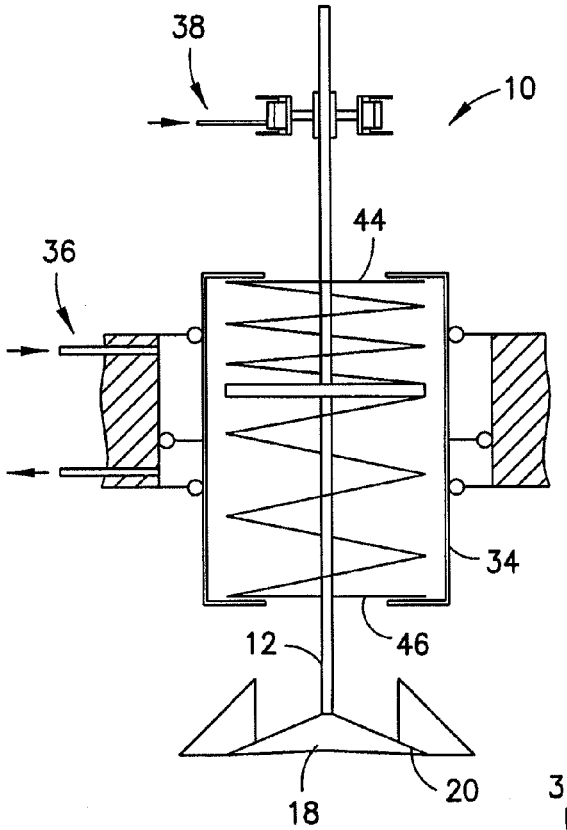
FIGS. 3*a-d* show the valve control from FIG. 1 during opening of the gas exchange valve.
Figure 3B:
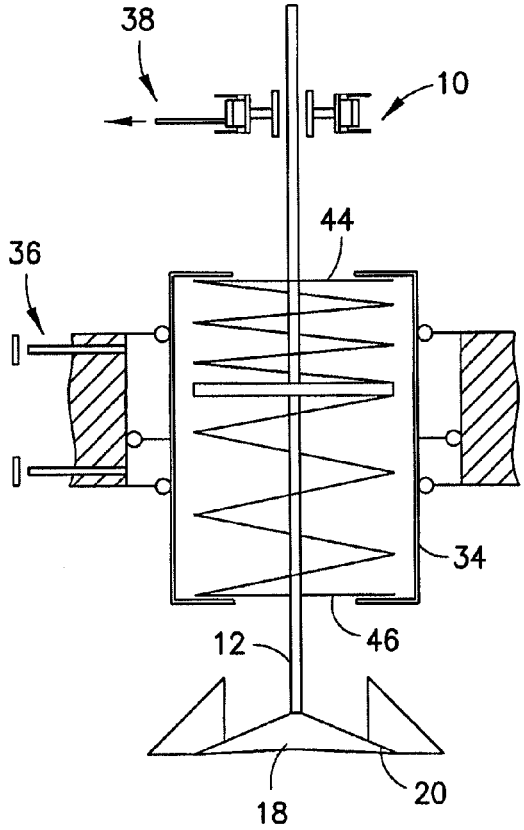
Figure 3C:
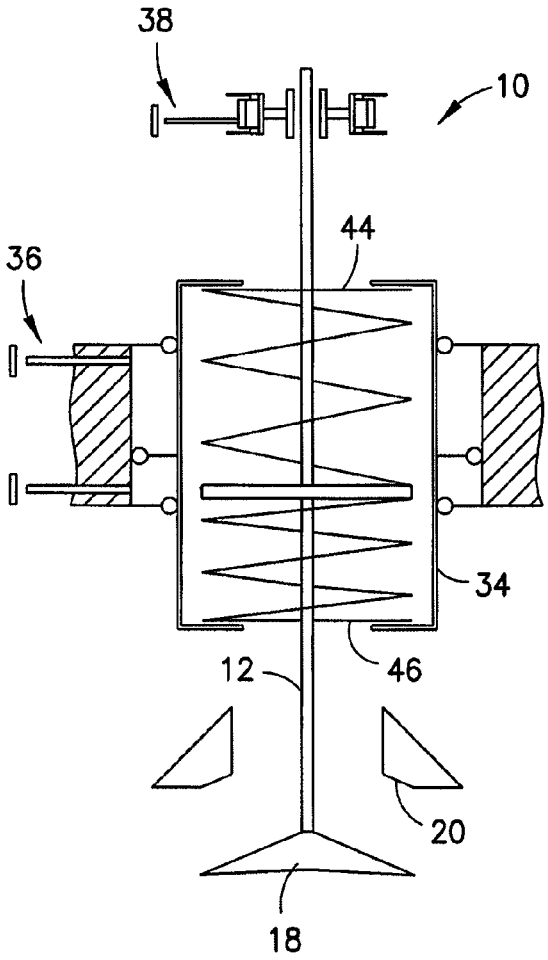

In a next step, as shown in FIG. 3*b*, the fixing device 38 is deactivated so that it opens and releases the valve 12. Following the release of the valve 12 the latter is accelerated by the two compression springs 44 and 46 away from the valve seat 20 so that the valve 12 opens as shown in FIG. 3*c*. In the process, the first compression spring 44 relaxes while the second compression spring 46 is compressed. Due to the inertia the valve in the process moves beyond the point of equilibrium of the spring system until the preload built-up in the compression springs has completely braked-down the valve so that a major part of the energy stored in the first compression spring 44 prior to the opening of the fixing device 38 is re-absorbed by the second compression spring 46.

Figure 3D:
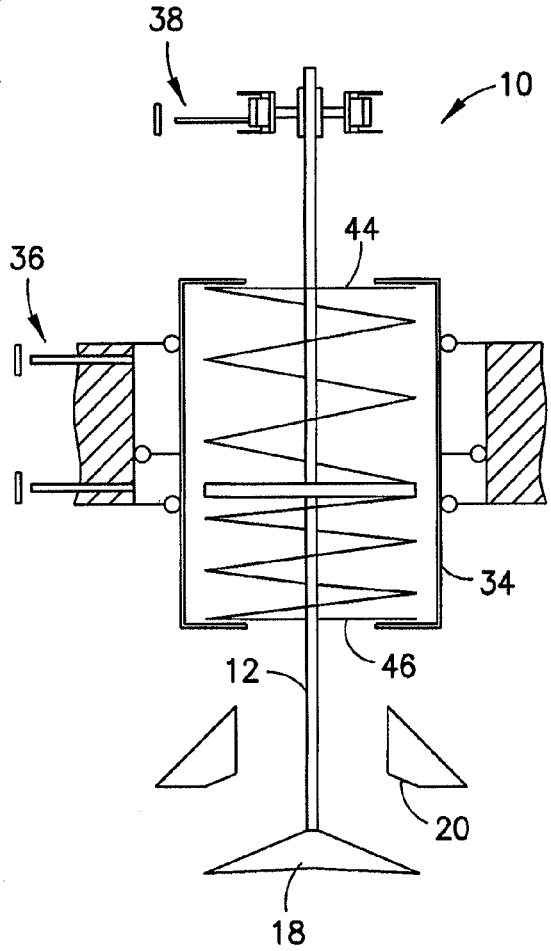
Figure 4A:
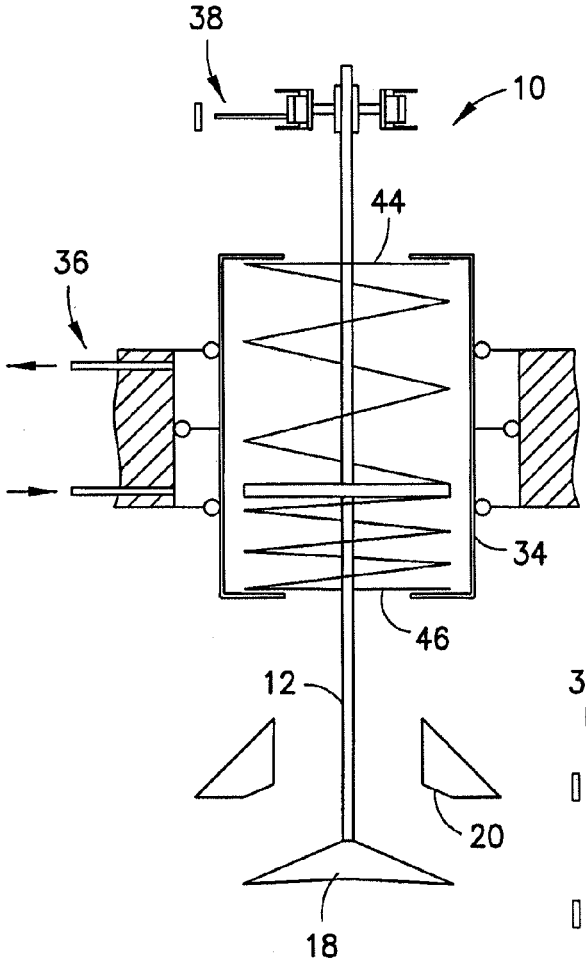
FIGS. 4*a-d* the valve control from FIG. 1 during closing of the gas exchange valve.

As soon as the valve 12 has reached its dead center position, at which the valve 12 would move back in the direction of the valve seat 18, the regulation device 40 based on the signals of the second travel sensor 66 activates the fixing device 38 which again clamps the valve 12 holding it in its open position as shown in FIG. 3*d*. If it is now intended for the valve 12 to be closed again, this process is shown in FIG. 4*a* to 4*d*, the regulation device 40 initially activates the actuation device 36 in such a manner that the insert 34 is moved away from the valve seat 20, i.e. is lifted. As a result, the second already pre-compressed compression spring 46 is further compressed while the first compression spring 44 is elongated as shown in FIG. 4*a*. This offsets more preferably friction-related energy losses of the spring system capable of oscillation.

Figure 4B:
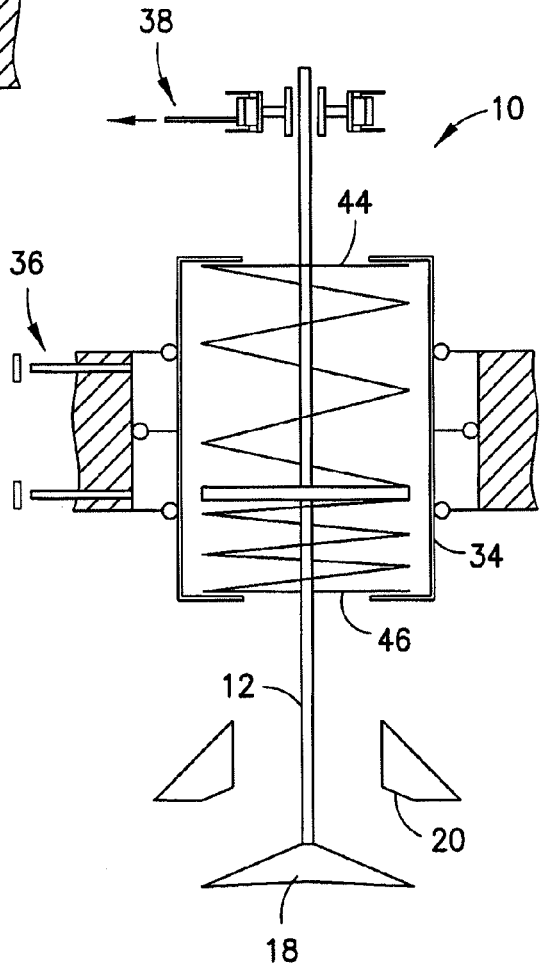

As soon as the first travel sensor 60 senses that the insert 34 is adequately lifted, the actuation device 36 is deactivated so that the insert 34 is hydraulically clamped in its new position (refer FIG. 4*b*).

Figure 4C:
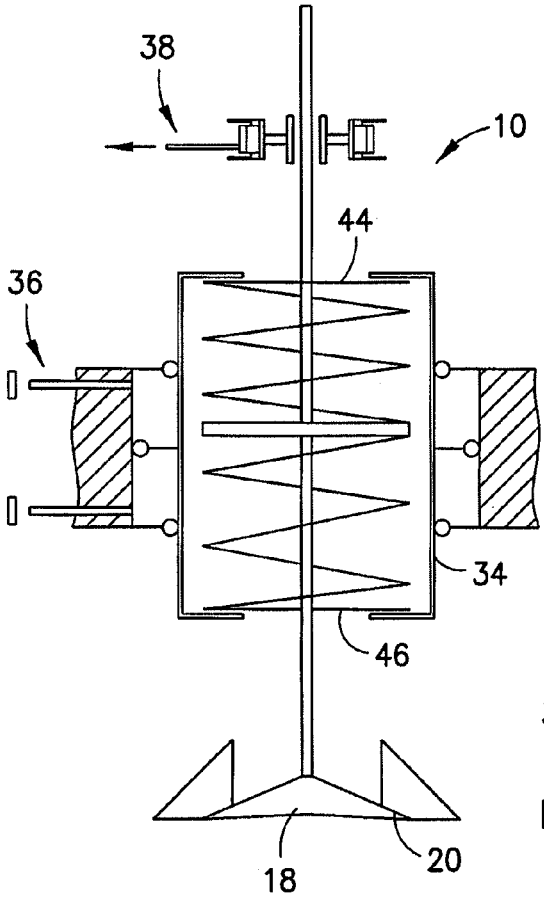

After this, the fixing device 38 closed to that point is opened so that the valve 12 because of the preload of the two compression springs 44 and 46 returns to its closed position as shown in FIG. 4*c*. In the process the second compression spring 46 relaxes while the first compression spring 44 is again compressed.

Figure 4D:
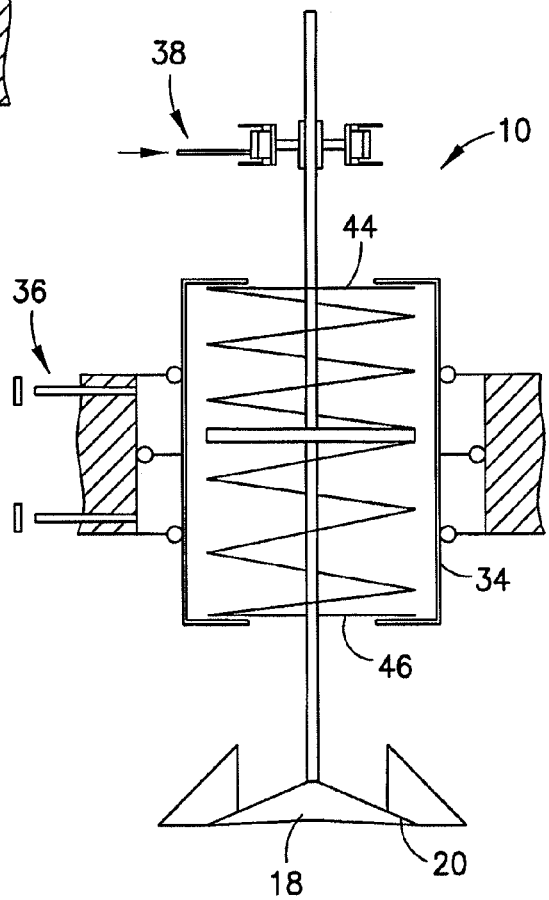

As soon as the second travel sensor 66 senses that the valve 12 is closed the fixing device 38 is reactivated and the valve 12 secured in its closed end position as shown in FIG. 4*d*.

For preloading again, the insert 34 now has to be adjusted in the direction of the valve seat 20 until the insert 34 again assumes the position shown in FIG. 3*a*.

With the valve control according to the invention it is possible, in a highly specific manner and, other than with mechanical valve controls, with respect to time entirely independent of the actual operation of the internal combustion engine, to set the opening time, the opening duration and the valve stroke. The actuation movements of the insert 34, as well as the time of holding the valve 12 with the help of the fixing device 36 can be specifically set and predetermined by the regulating device 40 based on the operating parameters of the internal combustion engine. It is also possible to have the movement of the insert 34 and the release or the closing of the fixing device 36 occur simultaneously, more preferably overlapping each other, instead of staggered in time. Moreover, the amount of the preload force with which the compression springs 44 and 46 are preloaded can be adjusted continuously.

Furthermore, the valve control 10 according to the invention can be provided for one or a plurality of valves 12 of a cylinder so that opening and closing of the individual valves independent of one another is likewise possible. The valve control according to the invention is suitable for any kind of internal combustion engine, for example spark-ignition engines and diesel engines which can be arranged moveably for example in land-based or sea-going vehicles as well as in stationary applications. Furthermore it should be noted that activating the actuation device 34 and the fixing device 36 can also take place purely hydraulically. Electrically operated devices can also be used instead of the hydraulically operated actuation device 34 and the fixing device 36.

Because of the swinging-through of the valve through the rest position of the spring system 44, 46 due to the inertia, only minor hydraulic work has to be advantageously expended for preloading.

The invention is not limited by the embodiments described above which are presented as examples only but can be modified in various ways within the scope of protection defined by the appended patent claims.

I claim:

1. A valve control for gas exchange in an internal combustion engine comprising a cylinder head with inlet and exhaust openings, the valve control comprising:

a valve comprising a valve disc and a valve stem which is movable in an actuation direction to open and close one of the openings;

a fixing device for releasably fixing the valve stem relative to the cylinder head;

at least one spring element for preloading the valve in an end position;

a movable insert which is movable in the cylinder head and supports the spring element for preloading the valve; and an actuation device which moves the insert in said actuation direction between an end position near the valve disc and an end position remote from the valve disc.

2. The valve control of claim 1 wherein the at least one spring element comprises a pair of compression springs supported in the insert and acting against each other to preload the valve in respective opposite end positions.

3. The valve control of claim 1 wherein the actuation device is a hydraulically operated.

4. The valve control of claim 3 wherein the actuation device comprises an actuation chamber in which the insert is moved hydraulically.

5. The valve control of claim 1 wherein the fixing device comprises an actuator having a clamping device which engages the valve stem.

6. The valve control of claim 5 wherein the actuator is hydraulically operated.

7. The valve control of claim 1 further comprising a first travel sensor for sensing the position of the insert relative to the cylinder head.

8. The valve control of claim 1 further comprising a second travel sensor for sensing the position of the valve relative to the cylinder head.

9. The valve control of claim 1 further comprising an engine control which utilizes sensed engine parameters to control at least one of the fixing device and the actuation device.

10. The valve control of claim 1 wherein the valve stem extends through the insert, the at least one spring insert being supported axially with respect to the valve stem.

11. The valve control of claim 10 wherein the valve stem comprises a first stem section passing for receiving through a valve guide adjacent to a valve seat in the head, a second stem section passing through the insert, and a coupling joining the first and second stem sections.

12. The valve control of claim 2 wherein the valve comprises collar extending radially from the stem, the compression springs being supported on opposite sides of the collar.

* * * * *